US012551807B2

(12) United States Patent
Kamiyama

(10) Patent No.: US 12,551,807 B2
(45) Date of Patent: Feb. 17, 2026

(54) TRAVELING TOY FOR FIGURE PLAY

(71) Applicant: EPOCH COMPANY, LTD., Tokyo (JP)

(72) Inventor: Kei Kamiyama, Tokyo (JP)

(73) Assignee: EPOCH COMPANY, LTD., Tokyo (JP)

( * ) Notice: Subject to any disclaimer, the term of this patent is extended or adjusted under 35 U.S.C. 154(b) by 174 days.

(21) Appl. No.: 18/383,982

(22) Filed: Oct. 26, 2023

(65) Prior Publication Data

US 2024/0139638 A1 May 2, 2024

(30) Foreign Application Priority Data

Oct. 27, 2022 (JP) ..... 2022-172177

(51) Int. Cl.
*A63H 17/05* (2006.01)
*A63H 3/52* (2022.01)
*A63H 33/00* (2006.01)

(52) U.S. Cl.
CPC ..... *A63H 17/05* (2013.01); *A63H 3/52* (2013.01); *A63H 33/003* (2013.01)

(58) Field of Classification Search
CPC ..... A63H 33/003; A63H 33/00
USPC ..... 446/71, 73, 75–77, 80, 465, 470; D3/271.12; D21/555, 558, 552, 433
See application file for complete search history.

(56) References Cited

U.S. PATENT DOCUMENTS

| | | | | | |
|---|---|---|---|---|---|
| 4,030,235 | A * | 6/1977 | Terzian | A63H 3/52 | 446/295 |
| 4,194,318 | A * | 3/1980 | Watanabe | A63H 17/26 | 446/296 |
| 4,516,948 | A * | 5/1985 | Obara | A63H 33/003 | 446/376 |
| 4,804,349 | A * | 2/1989 | Loscalzo | A63H 33/003 | 446/482 |
| 5,213,504 | A * | 5/1993 | Lee | G09B 11/06 | 106/31.86 |
| D379,481 | S * | 5/1997 | Johnson | D21/558 | |
| D710,460 | S * | 8/2014 | Hattori | D21/552 | |
| D952,763 | S * | 5/2022 | Zhong | D21/548 | |
| 2005/0112985 | A1* | 5/2005 | Ciccarelli | A63H 19/15 | 446/80 |
| 2025/0025799 | A1* | 1/2025 | Rice | B62K 9/00 | |

FOREIGN PATENT DOCUMENTS

| | | | | |
|---|---|---|---|---|
| GB | 2159721 A | * | 12/1985 | A63H 3/52 |
| JP | S6278989 U | * | 5/1987 | |
| JP | S63154091 U | * | 10/1988 | |
| JP | H02-035786 U | | 3/1990 | |

* cited by examiner

*Primary Examiner* — Kimberly S Berona
(74) *Attorney, Agent, or Firm* — Faegre Drinker Biddle & Reath LLP

(57) ABSTRACT

A traveling toy for figure play includes a first member, a second member and a third member. The first member includes a first traveling wheel. The second member is connected to the first member through a first hinge portion, and includes a second traveling wheel. The third member is provided to face the second member and connected to the first member through a second hinge portion. The third member includes a third traveling wheel.

6 Claims, 6 Drawing Sheets

TRAVELING TOY FOR FIGURE PLAY

CROSS-REFERENCE TO RELATED APPLICATIONS

This application is based on and claims priority under 35 USC 119 from Japanese Patent Application No. 2022-172177 filed on Oct. 27, 2022, the contents of which are incorporated herein by reference.

TECHNICAL FIELD

The present disclosure relates to a traveling toy for figure play.

BACKGROUND ART

In the related art, a travel toy for figure play such as a vehicle toy that can be played with a figure has been provided. For example, JPH02-035786U discloses a traveling toy for figure play, which is a traveling toy on which a plurality of figures can be placed and whose traveling direction can be changed by the figure disposed in the driver's seat.

SUMMARY OF INVENTION

In the traveling toy for figure play of the related art, it is possible to enjoy figure play by placing and unloading the figure on the traveling toy that imitates a vehicle, but it may be possible to make the figure play more enjoyable by changing the traveling toy itself.

The present disclosure provides a traveling toy for figure play that allows a user to enjoy a change in the traveling toy itself.

The present disclosure provides a traveling toy for figure play including: a first member including a first traveling wheel; a second member connected to the first member through a first hinge portion, the second member including a second traveling wheel; and a third member provided to face the second member and connected to the first member through a second hinge portion, the third member including a third traveling wheel.

According to the present disclosure, it is possible to provide the traveling toy for figure play that allows the user to enjoy a change in the traveling toy itself.

BRIEF DESCRIPTION OF DRAWINGS

The present disclosure will be described in detail based on the following without being limited thereto, wherein.

DESCRIPTION OF EMBODIMENTS

Figure 1:
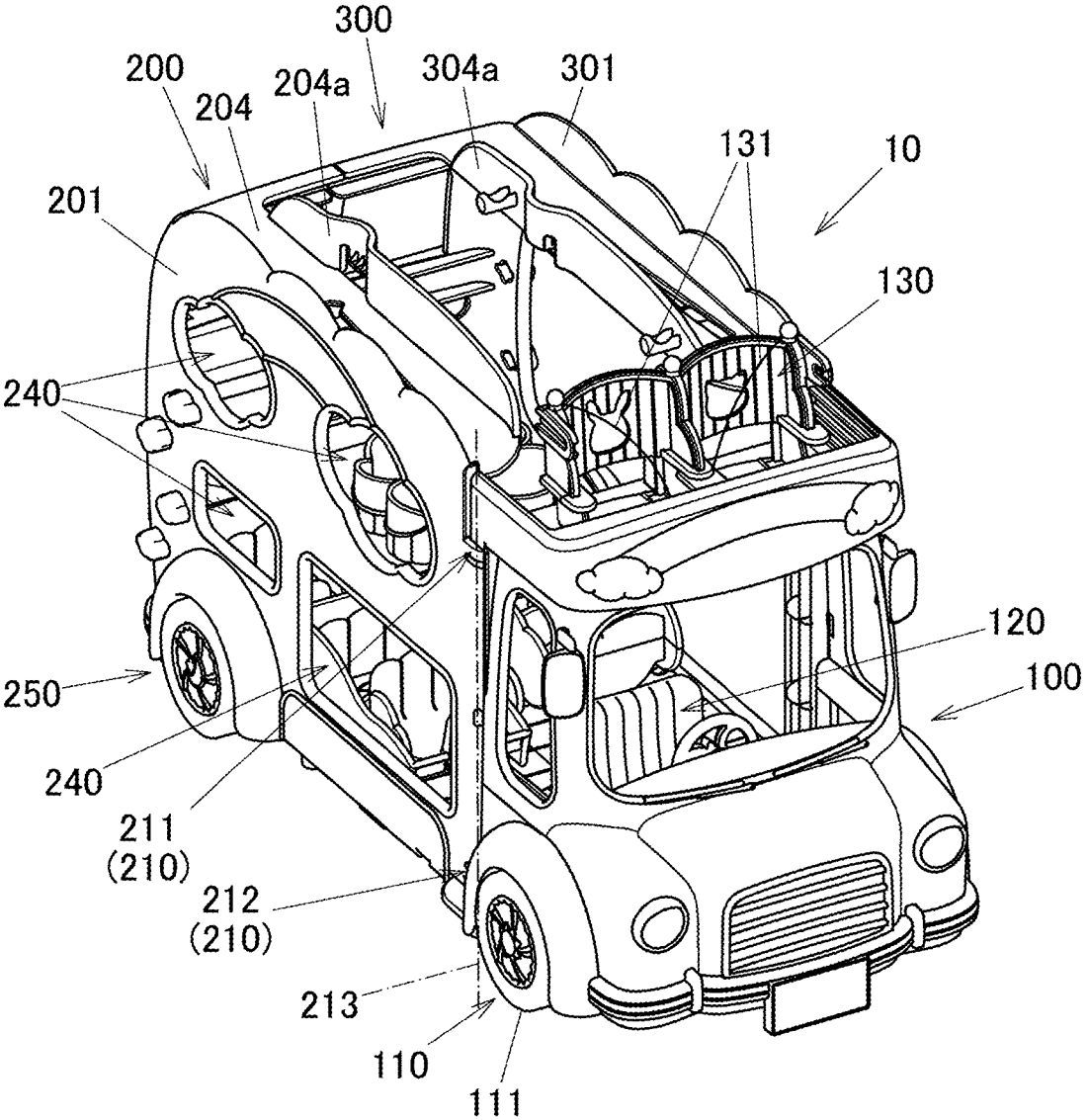
FIG. 1 is a perspective view of a traveling toy for figure play according to an embodiment of the present disclosure, when viewed from an upper right front side.
Figure 2:
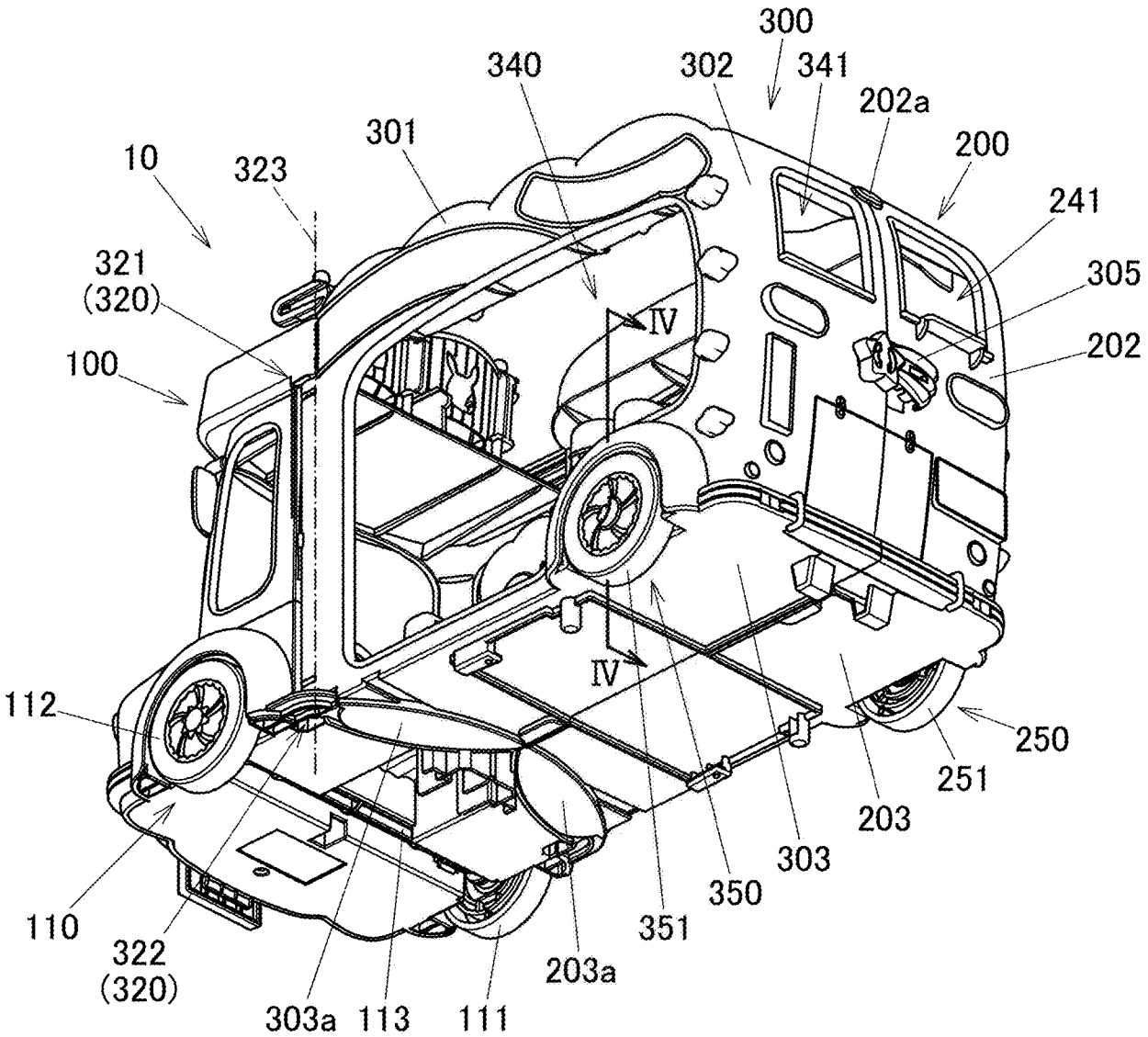
FIG. 2 is a perspective view of the traveling toy for figure play according to the embodiment of the present disclosure, when viewed from a lower left rear side.

Embodiments of the present disclosure will be described based on the drawings. A traveling toy for figure play 10 illustrated in FIGS. 1 and 2 is formed by imitating a shape of a bus. The traveling toy for figure play 10 includes a first member 100 corresponding to a front portion of the bus, a second member 200, and a third member 300 provided facing the second member 200. The second member 200 and the third member 300 correspond to a passenger compartment on a rear side of the bus.

Figure 5:
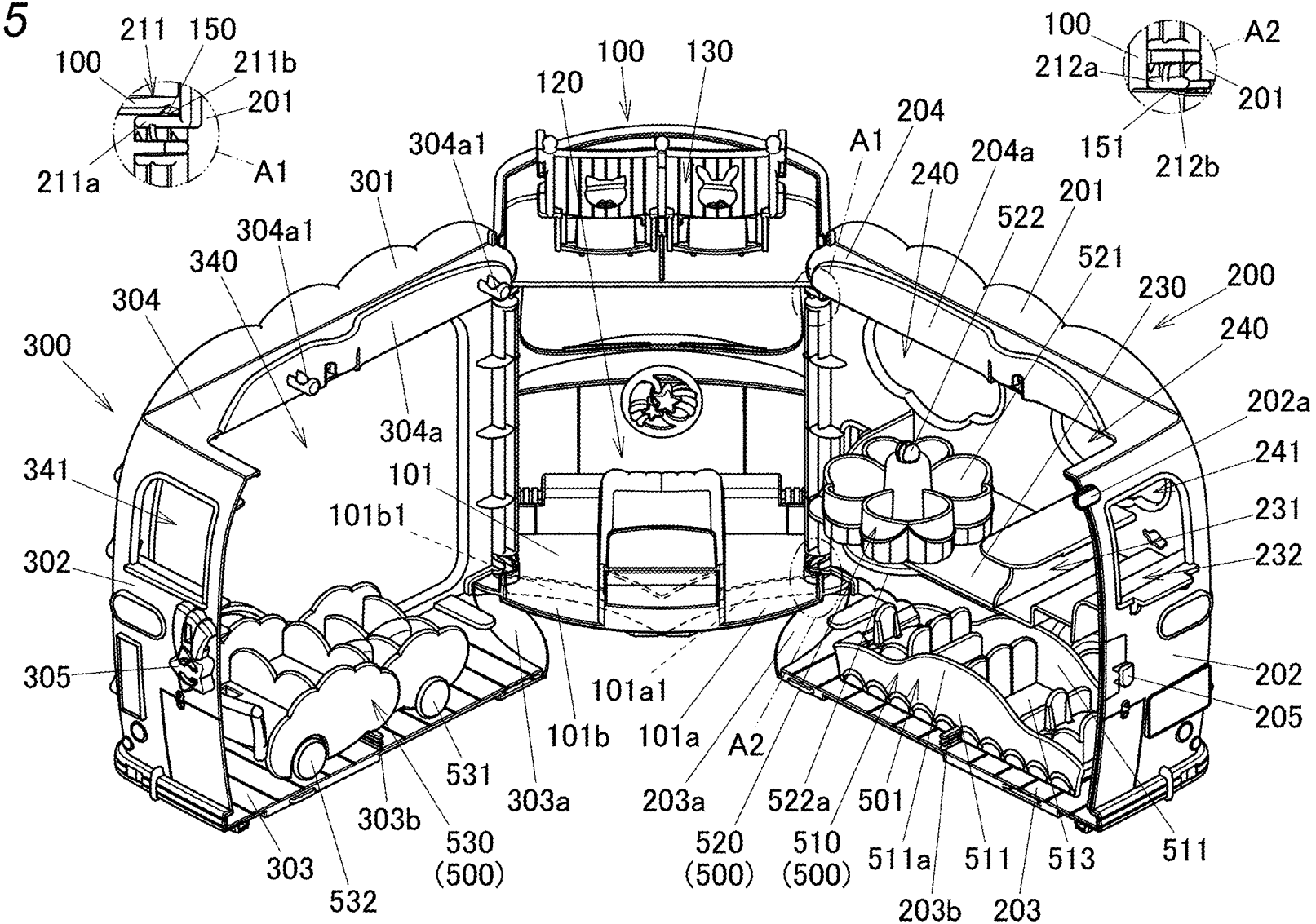
FIG. 5 is a perspective view of the traveling toy for figure play according to the embodiment of the present disclosure, when viewed from an upper rear side, illustrating a state in which a second member and a third member are opened.

Although not illustrated, a figure to be played using the traveling toy for figure play 10 is a figure imitating an animal or a person that is large enough to be played with an independent toy for figure play 500 provided inside a driver's seat 120, outer seats 130, the second member 200, and the third member 300 (see FIG. 5).

In the following description, the first member 100 side of the traveling toy for figure play 10 imitating the bus is referred to as the front, the opposite side thereof is referred to as the rear, and the left side and the right side when a figure is seated in the driver's seat 120 are referred to as the left and the right, respectively. The description will be made assuming that the upper side of the traveling toy for figure play 10 imitating the bus is top, and the lower side thereof is bottom.

In the first member 100, the driver's seat 120 is provided in the center of the room. Two outer seats 130 are provided on an upper surface of the first member 100. A small figure (not illustrated) can be placed on the driver's seat 120 and the outer seats 130. Each of the two outer seats 130 is provided with a string-shaped seat belt 131.

Figure 3:
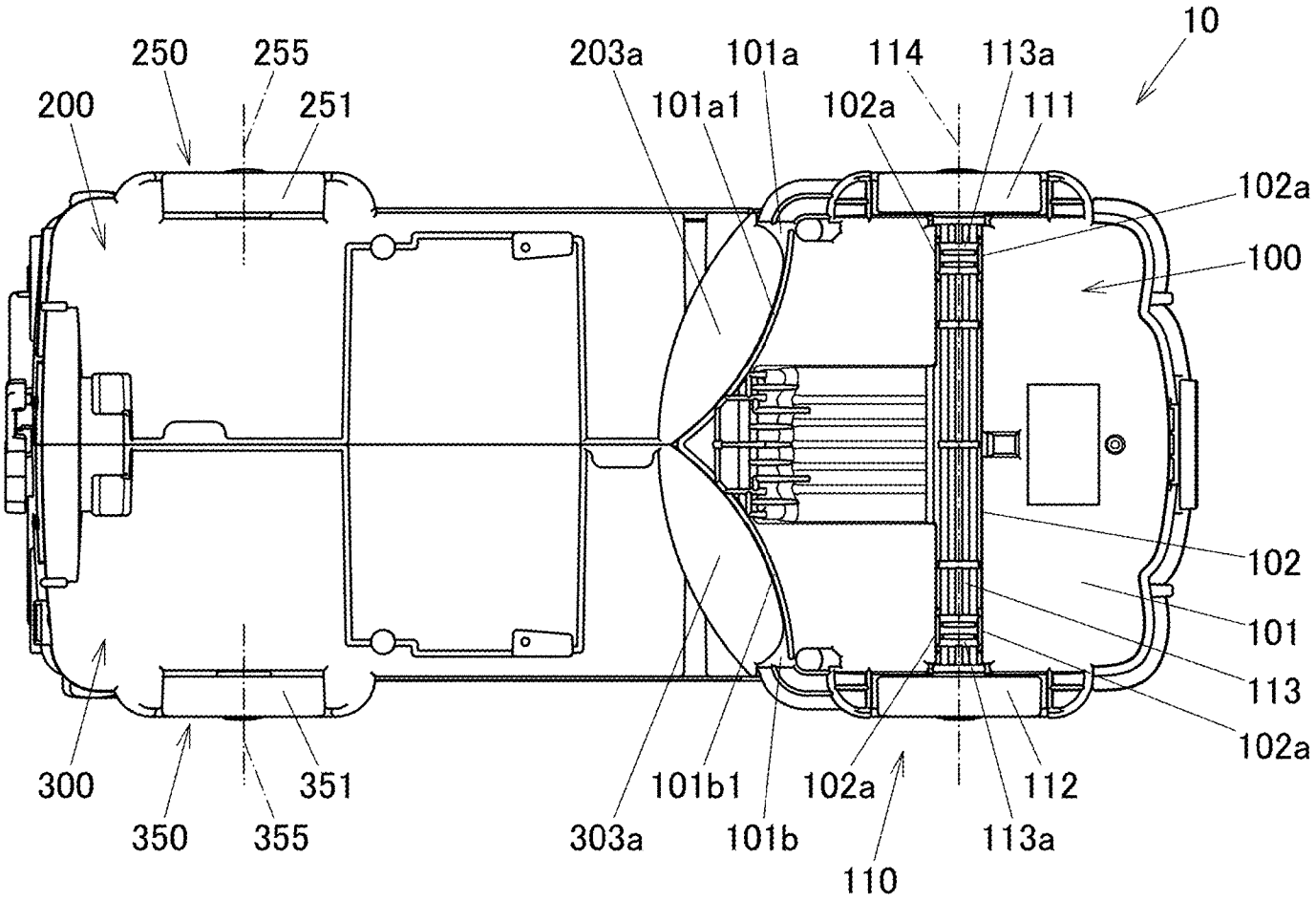
FIG. 3 is a bottom view of the traveling toy for figure play according to the embodiment of the present disclosure.

A first traveling wheel 110 is provided on a lower surface of the first member 100 to be freely rotatable. The first traveling wheel 110 is a front wheel of the traveling toy for figure play 10. As illustrated in FIGS. 2 and 3, the first traveling wheel 110 includes two wheels (right wheel 111, left wheel 112) and an axle 113 connecting the right wheel 111 and the left wheel 112. The axle 113 is provided on the lower surface of the first member 100 to be freely rotatable.

As illustrated in FIG. 3, a recess groove 102 is provided on a lower surface of a bottom plate 101 of the first member 100. In the recess groove 102, two facing protrusions 102*a* are respectively provided on the left and right sides of the groove 102. In the axle 113, three adjacent rings 113*a* are provided on each of the left and right sides of the axle 113. Each ring 113*a* is formed with a diameter slightly larger than that between the two facing protrusions 102*a*. The axle 113 is provided in the recess groove 102 with the rings 113*a* riding over the protrusions 102*a*, so that the axle 113 is provided to be freely rotatable without coming off from the recess groove 102.

The right wheel 111, the left wheel 112, and the axle 113 are fixed. Therefore, the right wheel 111 and the left wheel 112 integrally rotate around the axle 113. In other words, the first traveling wheel 110 is rotatably provided around a rotation axis 114, which is an axis of the axle 113. The rotation axis 114 is provided in the left and right direction of the first member 100.

The second member 200 and the third member 300 are shaped like the passenger compartment of the bus divided into left and right equal parts. The second member 200 on the right side includes a side surface plate 201 on the outer side illustrated in FIGS. 1 and 5, a rear surface plate 202 on the rear side illustrated in FIG. 5, and a bottom plate 203. Inside the second member 200, a substantially plate-shaped second floor plate 230 is provided substantially parallel to the bottom plate 203. The second member 200 is formed like a two-story bus by the second floor plate 230. A table-shaped partition portion 231 and a rear seat 232 are provided on the second floor plate 230.

The side surface plate 201 of the second member 200 illustrated in FIG. 1 is provided with opening windows 240, which have a rectangular shape having rounded corners and a cloud shape, corresponding to a first floor portion and a second floor portion. A rear opening window 241 that opens in a substantially square shape having rounded corners is provided at the upper part of the rear surface plate 202.

As illustrated in FIG. 5, a ceiling plate 204 of the second member 200 is formed narrower than the rear surface plate 202 and the bottom plate 203. The side surface plate 201 protrudes from the ceiling plate 204, is formed in a substantially circular arc shape with an upper end part thereof continuous, and has a cloud-like shape. Inside the ceiling plate 204, a wall plate 204*a* erected in a wall shape to face the side surface plate 201 protruding from the ceiling plate 204 is provided.

As illustrated in FIG. 1, a first hinge portion 210 is provided at the front side of the side surface plate 201 of the second member 200. The first hinge portion 210 includes an upper first hinge portion 211 and a lower first hinge portion 212. As illustrated in an encircled box A1 of FIG. 5, the upper first hinge portion 211 is provided with a hinge base portion 211*a* with plate surfaces thereof facing in the vertical direction to protrude from the side surface plate 201, and a protrusion 211*b* is provided on the upper surface of the hinge base portion 211*a*. The protrusion 211*b* engages a recess portion 150 provided in the first member 100 to face the protrusion 211*b*.

Similar to the upper first hinge portion 211, the lower first hinge portion 212 is provided with a protrusion 212*b* which protrudes to the lower surface of the hinge base portion 212*a* which protrudes from the side surface plate 201, as illustrated in an encircled box A2 of FIG. 5. The protrusion 212*b* engages a concave portion 151 provided on the first member 100 to face the protrusion 212*b*.

As such, a rotation axis 213 of the first hinge portion 210 (see FIG. 1, axis of protrusions 211*b* and 212*b*) is provided perpendicularly in the vertical direction, and the second member 200 is connected to the first member 100 through the first hinge portion 210.

The third member 300 includes a side surface plate 301 on the outer side illustrated in FIGS. 2 and 5, a rear surface plate 302, a bottom plate 303, and a ceiling plate 304 illustrated in FIG. 5. The side surface plate 301 protrudes from the ceiling plate 304 and has a convex arc shape so that an upper end thereof has a cloud shape. Inside the ceiling plate 304, a wall plate 304*a* is provided to face a portion of the side surface plate 301 protruding from the ceiling plate 304. Since there is a predetermined interval between the wall plates 204*a* and 304*a*, the user can enjoy viewing a state inside the passenger compartment from above.

The side surface plate 301 of the third member 300 is provided with an opening window 340 opened in a large, substantially square shape having rounded corners. An opening window 341 opened in a substantially square shape is provided on the rear surface plate 302.

As illustrated in FIG. 2, a second hinge portion 320 is provided on the front side of the side surface plate 301 of the third member 300. The second hinge portion 320 includes an upper second hinge portion 321 and a lower second hinge portion 322, and is configured similarly to the first hinge portion 210. The upper second hinge portion 321 and the lower second hinge portion 322 are engaged with each other in a protrusion-recess manner, similar to the upper first hinge portion 211 and the lower first hinge portion 212. The third member 300 rotates around a rotation axis 323 of the second hinge portion 320. As such, the third member 300 is connected to the first member 100 through the second hinge portion 320.

The second member 200 and the third member 300 includes a second traveling wheel 250 and a third traveling wheel 350, respectively. The second traveling wheel 250 and the third traveling wheel 350 include wheels 251 and 351, that are rotatably provided on the second member 200 and the third member 300, respectively. Since the second traveling wheel 250 and the third traveling wheel 350 have the same structure, the structure of the traveling wheels will be explained using the third traveling wheel 350 as an example.

Figure 4:
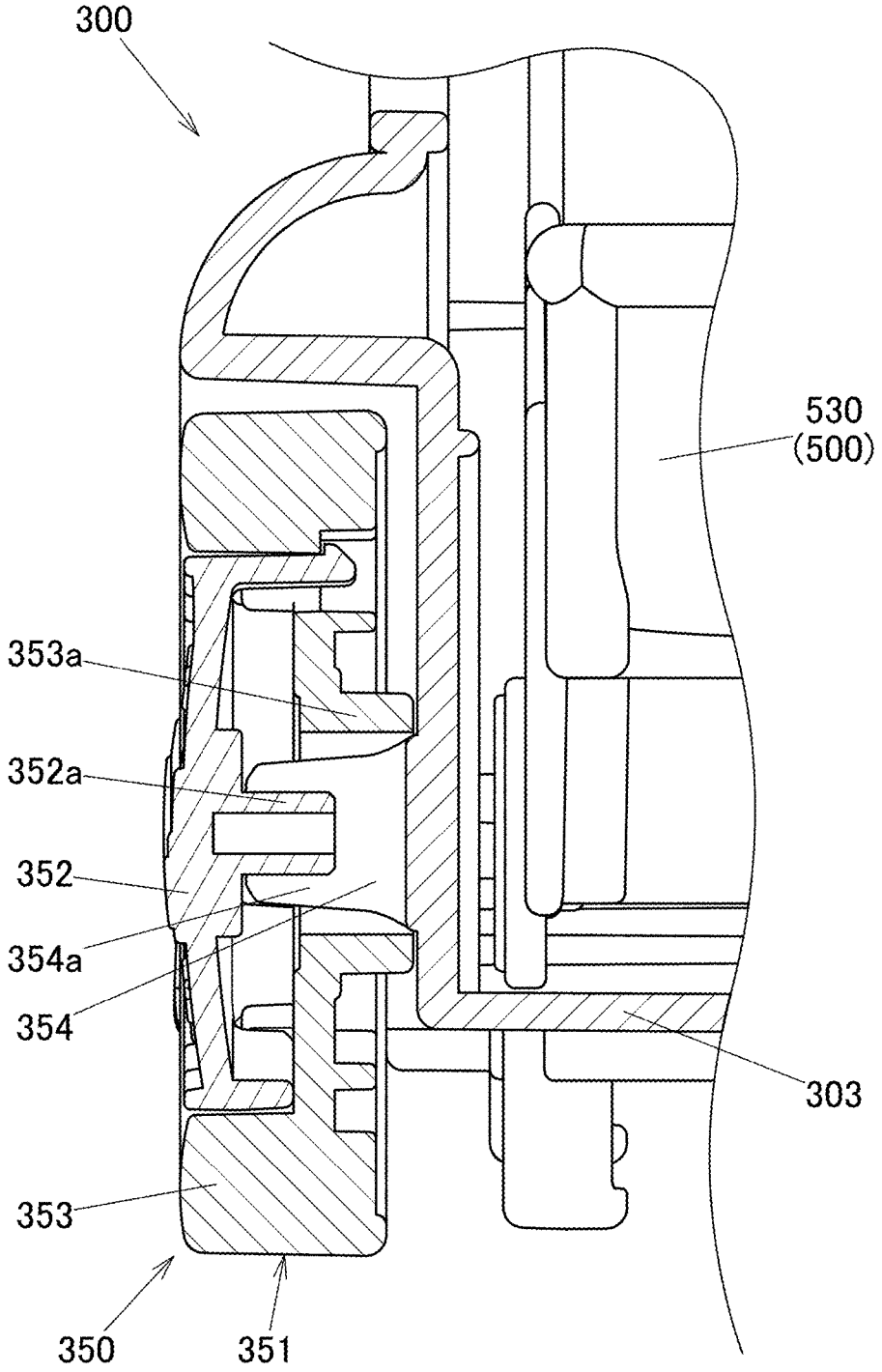
FIG. 4 is an enlarged cross-sectional view taken along line IV-IV in FIG. 2 of a wheel of the traveling toy for figure play according to the embodiment of the present disclosure.

As illustrated in FIG. 4, the wheel 351 is provided with a wheel member 352 and a tire member 353 fixed to the wheel member 352. The wheel member 352 includes a shaft 352*a* protruding toward the inside (the side surface plate 301 side). An inner cylinder 353*a* is formed in the tire member 353. Meanwhile, a bearing 354 protrudes from the third member 300. The bearing 354 is provided with two supporting portions 354*a* with a predetermined interval therebetween to sandwich the shaft 352*a*. The inner cylinder 353*a* provided in the tire member 353 is disposed around the bearing 354. As such, in the third traveling wheel 350, the wheel 351, the wheel member 352, and the tire member 353 rotate integrally around the axis of the shaft 352*a* (rotation axis 355, see FIG. 3).

As illustrated in FIG. 3, the wheel 251 of the second traveling wheel 250 and the wheel 351 of the third traveling wheel 350 are rotatably provided around the rotation axes 255 and 355, respectively. The rotation axes 255 and 355 are coaxially disposed. Therefore, the traveling toy for figure play 10 is supported like three-point support by the first traveling wheel 110 that rotates integrally, and the second traveling wheel 250 and the third traveling wheel 350 that rotate independently, so that the traveling toy for figure play 10 can travel stably.

Since the second traveling wheel 250 and the third traveling wheel 350 are not connected, the second member 200 and the third member 300 can be opened in the left and right direction, respectively. Therefore, the user can enjoy playing with the changing vehicle body.

As illustrated in FIG. 5, at front ends of the bottom plate 203 of the second member 200 and the bottom plate 303 of the third member 300, surface-sliding portions 203*a* and 303*a* having convex arc-shaped tip edges are formed. The surface-sliding portion 203*a* serves as an example of a first surface-sliding portion, and the surface-sliding portion 303*a* serves as an example of a second surface-sliding portion. When the second member 200 and the third member 300 are closed, the surface-sliding portions 203*a* and 303*a* are disposed on the lower surface side of the bottom plate 101 of the first member 100 (see FIGS. 2 and 3). When the second member 200 and the third member 300 are closed, the upper surfaces of the bottom plates 101, 203, and 303 become substantially continuous surfaces.

As illustrated in FIGS. 3 and 5, the bottom plate 101 of the first member 100 is provided with surface-sliding receiving portions 101*a* and 101*b*. The surface-sliding receiving portion 101*a* serves as an example of a first surface-sliding receiving portion, and the surface-sliding receiving portion 101*b* serves as an example of a second surface-sliding receiving portion. The surface-sliding receiving portions 101*a* and 101*b* are disposed on the upper side facing the surface-sliding portions 203*a* and 303*a* when the second member 200 and the third member 300 are closed. On the front side of the surface-sliding receiving portions 101*a* and 101*b*, contacting wall portions 101*a*1 and 101*b*1 are formed which have a rib-shaped convex arc shape and come into contact with the surface-sliding portions 203*a* and 303*a*. The rear edges of the surface-sliding receiving portions 101*a* and 101*b* are formed in a convex arc shape, similar to the tip edges of the surface-sliding portions 203*a* and 303*a*. The upper surfaces of the surface-sliding portions 203*a* and 303*a* and the lower surfaces of the surface-sliding receiving portions 101*a* and 101*b* come into sliding contact with each other during the opening and closing operation of the second member 200 and the third member 300 (opening and closing operation of the second member 200 or the third member 300 by the first hinge portion 210 or the second hinge portion 320).

The surface-sliding portions 203*a* and 303*a* and the surface-sliding receiving portions 101*a*, 101*b* have edges that substantially face each other in the horizontal direction (for example, closing directions of the second member 200 and the third member 300) and are formed in a convex arc shape. Therefore, even if a finger is inserted between the facing edges of the surface-sliding portions 203*a* and 303*a* and the surface-sliding receiving portions 101*a* and 101*b*, the finger is easily pushed out when the second member 200 and third member 300 are closed. The edge of the surface-sliding portion 203*a* and the edge of the surface-sliding receiving portion 101*a* serve as an example of first edges, and the edge of the surface-sliding portion 303*a* and the edge of the surface-sliding receiving portion 101*b* serve as an example of second edges.

A regulating portion 202*a* imitating a tail lamp is provided on the upper part of the rear surface plate 202 of the second member 200. The regulating portion 202*a* is provided to protrude beyond the edge of the rear surface plate 202. When the second member 200 and the third member 300 are closed by the regulating portion 202*a*, an outer surface of the rear surface plate 302 of the third member 300 is guided by the inner surface of the regulating portion 202*a*, and a positional deviation between the second member 200 and the third member 300 hardly occurs.

A lock member 305 is provided on the rear surface plate 302 of the third member 300 to be freely rotatable. The lock member 305 can lock the opening operation of the second member 200 and the third member 300 by engaging an engagement protrusion 205 provided on the rear surface plate 202 of the second member 200.

As illustrated in FIG. 5, inside the second member 200 and the third member 300, three independent toys for figure play 500 (independent toys for figure play 510, 520, and 530), which can be used for figure play independently, are stored separately from the traveling toy for figure play 10.

Figure 6:
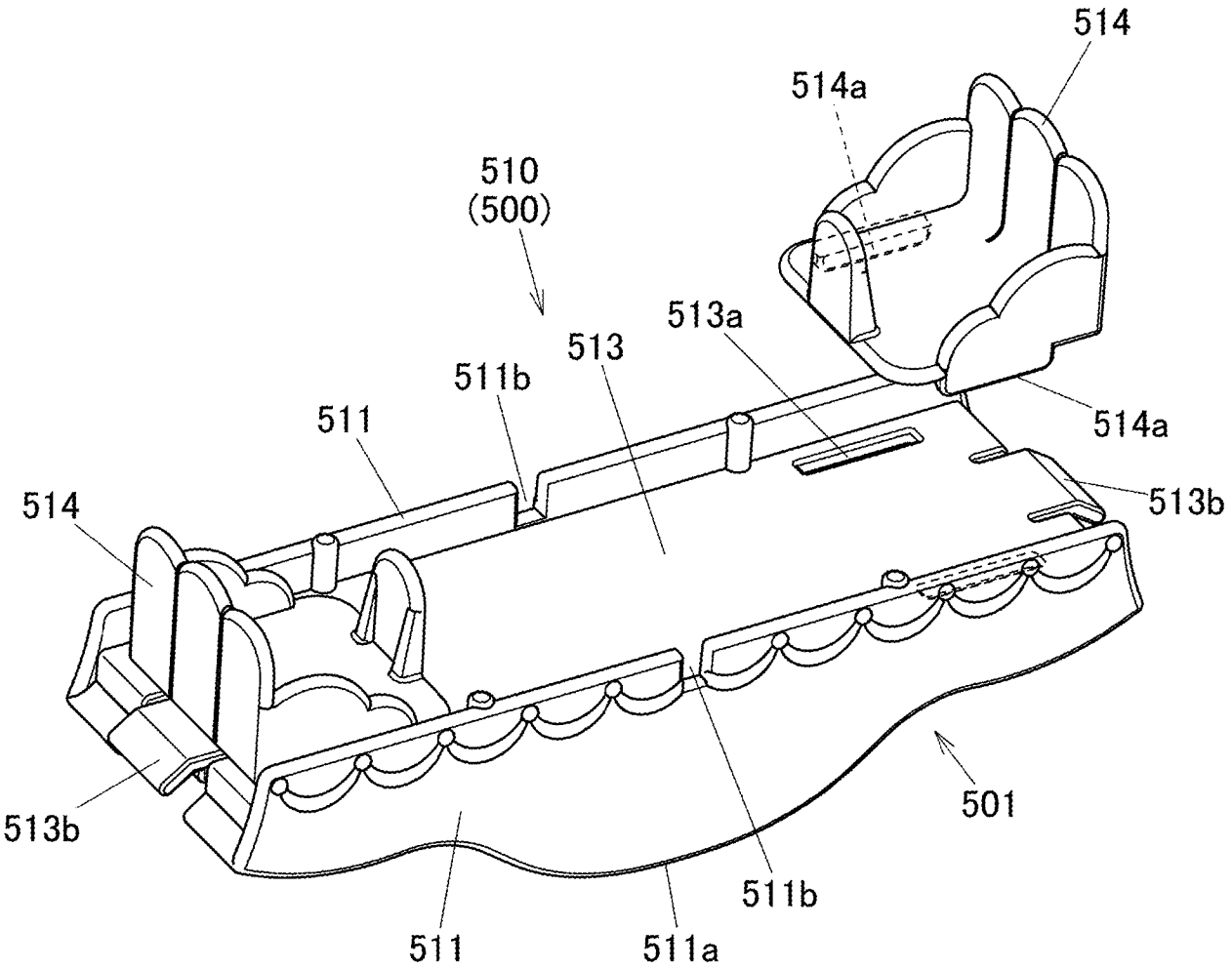
FIG. 6 is a perspective view illustrating a state in which an independent toy for figure play provided in the traveling toy for figure play according to the embodiment of the present disclosure is being used independently.

As illustrated in FIG. 6, by placing the independent toy for figure play 510 stored on the bottom plate 203 of a first floor part of the second member 200 on a desk or the like, in an opposite manner to a state in which the independent toy for figure play 510 is attached to the traveling toy for figure play 10, it is possible to play seesaw with the independent toy for figure play 510. The independent toy for figure play 510 includes a plurality of two seats 514 and a seesaw main body 501. The seesaw main body 501 is provided with two side plates 511 that are long in the front and rear direction and are provided facing each other.

In a substantially central part of the side plate 511, a bulging portion 511*a* that bulges out in a substantially mountain shape on one side (a first surface side) of the seesaw main body 501 is formed. A recess groove 511*b* is provided in a portion of the side plate 511 (the other side (a second surface side) of the seesaw main body 501) that opposes the bulging portion 511*a*, and engages an elongated protrusion 203*b* (see FIG. 5) provided on the bottom plate 203 of the second member 200 in a protrusion-recess manner to restrict movement of the seesaw main body 501. The independent toy for figure play 510 is stored in the second member 200 to be freely attachable thereto and detachable therefrom by the protrusion-recess engagement between the recess groove 511*b* and the elongated protrusion 203*b*.

A support plate 513 is provided between the two side plates 511 of the seesaw main body 501, with the plate surfaces thereof facing in the vertical direction. Two seats 514 including backrests are provided on the support plate 513 to be freely attached and detached. A figure used for figure play can be seated on the seat 514.

When the independent toy for figure play 510 is attached to the traveling toy for figure play 10 as illustrated in FIG. 5, the seat 514 is attached to one side of the support plate 513 with the bulging portion 511*a* of the side plate 511 facing upward. The seat 514 is fixed by fitting two protrusions 514*a* provided on the lower surface of the sheet 514 into through-hole portions 513*a* that are provided in the support plate 513 in pairs at two locations in the front and rear sides.

When removing the independent toy for figure play 510 from the traveling toy for figure play 10 and playing with the independent toy for figure play 510 independently, the seat 514 is removed from the seesaw main body 501, and the seat 514 is attached to the other side of the support plate 513 of the seesaw main body 501 with the bulging portion 511*a* placed on a desk or the like. That is, the seat 514 is attached to the support plate 513 on the opposite side from when the independent toy for figure play 510 is attached to the traveling toy for figure play 10.

In attaching the seat 514 to the support plate 513, the seats 514 can be attached to the support plate 513 so that both two seats face toward the front side when the independent toy for figure play 510 is attached to the traveling toy for figure play 10, and the seats 514 can be attached to the support plate 513 so that the seats 514 face each other when playing seesaw with the independent toy for figure play 510.

The seesaw main body 501 is provided with tongue piece-shaped locking portions 513*b* that are respectively provided at both side ends of the support plate 513. With the second member 200 and third member 300 open, the seesaw body 501 can also be played as a slide by being engaged to the second floor plate 230 of the second member 200 with the other side of the support plate 513 facing upward to be sandwiched between one locking portion 513*b* and an end portion of the support plate 513 and installing an end of the support plate 513 on the other locking portion 513*b* side on a desk or the like.

As illustrated in FIG. 5, in the second floor portion of the second member 200, an independent toy for figure play 520 is attached to the second floor plate 230 to be freely attached and detached. The independent toy for figure play 520 includes a rotating body 521 including four four-leaf clover-shaped seats, and a shaft portion 522 provided at the center of the rotating body 521 as a rotating shaft. The shaft portion 522 is provided with a disk-shaped installation portion 522*a* provided at the lower end, and a locking disk portion (not illustrated) provided on the upper side of the installation portion 522*a*.

The independent toy for figure play 520 is attached to the second floor plate 230 by inserting the shaft portion 522 between the locking disk portion and the installation portion 522*a* into a U-shaped groove (not illustrated) provided on the second floor plate 230. When using the independent toy for figure play 520 in figure play, a user can play by installing the installation portion 522*a* on a desk or the like and rotating a rotating body on which the FIG. is placed around the shaft portion 522.

An independent toy for figure play 530 is stored in the third member 300 to be freely attached and detached. The independent toy for figure play 530 is a four-wheeled vehicle toy including front wheels 531 and rear wheels 532, and a figure can be placed inside thereof. A recess groove (not illustrated) is provided on the lower surface of the independent toy for figure play 530, and engages an elongated protrusion 303*b* of the bottom plate 303 in a protrusion-recess manner. The independent toy for figure play 530 can be freely attachable to and detachable from the third member 300 by the protrusion-recess engagement between the recess groove and the elongated protrusion 303*b* provided parallel to the rotation axis 355. By the protrusion-recess engagement, a possibility that the independent toy for figure play 530 moves back and forth and the figure placed on the independent toy for figure play 530 falls off is reduced when the traveling toy for figure play 10 is traveled and played with the second member 200 and the third member 300 closed.

The wall plate 304*a* of the ceiling plate 304 of the third member 300 is provided with two locking rods 304*a*1 that protrude inward (the direction opposite to the side where the third traveling wheel 350 is provided). Here, the outer seat 130 of the first member 100 is freely attachable and detachable. If the string-shaped seat belt 131 is hung on the locking rod 304*a*1, the outer seat 130 can be played with as a swing. Since the opening window 340 of the third member 300 is largely opened, the user can play with the outer seat 130 as a swing without interfering with the third member 300.

According to the embodiments of the present disclosure as described above, a vehicle toy according to following aspects can be provided.

A traveling toy for figure play according to a first aspect includes: a first member including a first traveling wheel; a second member connected to the first member through a first hinge portion, the second member including a second traveling wheel; and a third member provided to face the second member and connected to the first member through a second hinge portion, the third member including a third traveling wheel.

According to such configuration, since the traveling toy for figure play can be traveled stably in a three-point support state by the first running wheel that rotates integrally, the second traveling wheel, and the third traveling wheel, and the second and third members can be opened and closed, it is possible to provide a traveling toy for figure play that allows a user to enjoy a change in the traveling toy itself.

In the traveling toy for figure play according to a second aspect, the first traveling wheel includes two wheels and an axle connecting the two wheels.

According to such configuration, it is possible to make a traveling toy with four wheels together with the second traveling wheel and the third traveling wheel, and accordingly, it is possible to provide a traveling toy for figure play that imitates a vehicle, such as a bus or a car, that is easy for an infant to get used to.

In the traveling toy for figure play according to a third aspect, the first member includes a first surface-sliding receiving portion and a second surface-sliding receiving portion, the second member includes a first surface-sliding portion, and the third member includes a second surface-sliding portion, and the first surface-sliding portion is configured to slidably contact the first surface-sliding receiving portion during an opening and closing operation of the second member with the first hinge portion, and the second surface-sliding portion is configured to slidably contact the second surface-sliding receiving portion during an opening and closing operation of the third member with the second hinge portion.

According to such configuration, since the opening and closing operations of the second member and the third member are guided by the sliding contact between the surfaces of the surface-sliding portion and the surface-sliding receiving portion, even children who are not good at delicate operations can easily perform the opening and closing operation of the second member and third member.

In the traveling toy for figure play according to a fourth aspect, the first surface-sliding receiving portion and the first surface-sliding portion have respective first edges facing each other with respect to a closing direction of the second member, the first edges being formed in an arc shape, and the second surface-sliding receiving portion and the second surface-sliding portion have respective second edges facing each other with respect to a closing direction of the third member, the second edges being formed in an arc shape.

According to such configuration, even if the operation of closing the second member and the third member is performed with a finger inserted between the surface-sliding receiving portion and the surface-sliding portion, the finger that is caught can be pushed out by the gradually narrowing arc-shaped edges.

In the traveling toy for figure play according to a fifth aspect, at least one of the second member or the third member is configured to engage and store therein an independent toy for figure play, the independent toy for figure play being able to be independently played with a figure, and the independent toy for figure play includes: a seesaw main body including a first surface and a second surface opposite to the first surface, the seesaw main body including a bulging portion formed on the first surface; and at least one seat attachable to and detachable from the first surface and the second surface.

According to such configuration, the independent toy for figure play which is easily attachable and detachable by the protrusion-recess engagement can be stored in the traveling toy for figure play, the independent toy for figure play can be removed from the traveling toy for figure play and turned over to play seesaw, and the user can also play with the independent toy for figure play while enjoying such a mode of change.

In the traveling toy for figure play according to a sixth aspect, rotation axes of the first hinge portion and the second hinge portion are perpendicular to each of rotation axes of the first traveling wheel, the second traveling wheel, and the third traveling wheel.

According to such configuration, it is possible to provide a traveling toy for figure play in which the second member and the third member can be provided to be opened left and right with the traveling direction being the front and rear direction, and which changes in a way that is easy for small children to understand.

Although the embodiments of the present disclosure have been described above, the present disclosure is not limited to the embodiments described above, and various changes can be made thereto without departing from the scope of the present disclosure.

What is claimed is:

1. A traveling toy for figure play comprising:

a first member comprising a first traveling wheel;

a second member connected to the first member through a first hinge portion, the second member comprising a second traveling wheel; and a third member provided to face the second member and connected to the first member through a second hinge portion, the third member comprising a third traveling wheel, wherein the first member comprises a first surface-sliding receiving portion, wherein the second member comprises a first surface-sliding portion, and wherein the first surface-sliding portion is configured to slidably contact the first surface-sliding receiving portion during an opening and closing operation of the second member with the first hinge portion.

2. The traveling toy for figure play according to claim 1, wherein the first traveling wheel comprises two wheels and an axle connecting the two wheels.

3. The traveling toy for figure play according to claim 1, wherein the first member further comprises a second surface-sliding receiving portion, wherein the third member comprises a second surface-sliding portion, and wherein the second surface-sliding portion is configured to slidably contact the second surface-sliding receiving portion during an opening and closing operation of the third member with the second hinge portion.

4. The traveling toy for figure play according to claim 3, wherein the first surface-sliding receiving portion and the first surface-sliding portion have respective first edges facing each other with respect to a closing direction of the second member, the first edges being formed in an arc shape, and the second surface-sliding receiving portion and the second surface-sliding portion have respective second edges facing each other with respect to a closing direction of the third member, the second edges being formed in an arc shape.

5. The traveling toy for figure play according to claim 1, wherein at least one of the second member or the third member is configured to engage and store therein an independent toy for figure play, the independent toy for figure play being able to be independently played with a figure, and wherein the independent toy for figure play comprises:

a seesaw main body comprising a first surface and a second surface opposite to the first surface, the seesaw main body comprising a bulging portion formed on the first surface; and at least one seat attachable to and detachable from the first surface and the second surface.

6. The traveling toy for figure play according to claim 1, wherein rotation axes of the first hinge portion and the second hinge portion are perpendicular to each of rotation axes of the first traveling wheel, the second traveling wheel, and the third traveling wheel.

* * * * *